US011365919B2

(12) United States Patent
Lund et al.

(10) Patent No.: US 11,365,919 B2
(45) Date of Patent: Jun. 21, 2022

(54) APPARATUS FOR REMOVING NON-CONDENSABLE GASES FROM A REFRIGERANT

(71) Applicant: Danfoss A/S, Nordborg (DK)

(72) Inventors: Thomas Lund, Nordborg (DK); Johan Van Beek, Almind (DK); Niels P. Vestergaard, Nordborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 17/044,395

(22) PCT Filed: Jul. 2, 2019

(86) PCT No.: PCT/EP2019/067750
§ 371 (c)(1),
(2) Date: Oct. 1, 2020

(87) PCT Pub. No.: WO2020/007866
PCT Pub. Date: Jan. 9, 2020

(65) Prior Publication Data

US 2021/0102737 A1 Apr. 8, 2021

(30) Foreign Application Priority Data

Jul. 6, 2018 (EP) ..... 8182229

(51) Int. Cl.
*F25B 43/04* (2006.01)

(52) U.S. Cl.
CPC ..... *F25B 43/043* (2013.01)

(58) Field of Classification Search
CPC ..... F25B 43/043; F25B 7/00; F25B 43/00; F25B 1/00; F25B 43/04; F25B 2400/05;
(Continued)

(56) References Cited

U.S. PATENT DOCUMENTS 1,709,588 A * 4/1929 Lenning ..... F25B 15/10 62/492
2,172,239 A * 9/1939 Cather ..... F25B 43/04 62/195

(Continued)

FOREIGN PATENT DOCUMENTS

CN 102527070 A 7/2012
CN 103228964 A 7/2013

(Continued)

OTHER PUBLICATIONS

International Search Report For Serial No. PCT/EP2019/067750 dated Aug. 8, 2019.

(Continued)

*Primary Examiner* — Frantz F Jules
*Assistant Examiner* — Martha Tadesse
(74) *Attorney, Agent, or Firm* — McCormick, Paulding & Huber PLLC

(57) ABSTRACT

An apparatus (1) for removing non-condensable gases from a refrigerant is described, said apparatus (1) comprising a pipe arrangement (2) having a pipe (3), cooling means (4) for the pipe (3), and venting means, wherein the pipe (3) comprises a connection geometry (5) for a connection to a refrigerant system. Such an apparatus should be operated with good efficiency. To this end the pipe comprises at least a first section (6) and a second section (7) which are directed in different directions.

20 Claims, 2 Drawing Sheets

(58) Field of Classification Search
CPC ..... B23P 15/26; B01D 5/0003; B01D 5/0006; B01D 53/02; B01D 53/265; F28B 1/00
See application file for complete search history.

(56) References Cited

U.S. PATENT DOCUMENTS

| | | | | | |
|---|---|---|---|---|---|
| 2,869,332 | A * | 1/1959 | Keller | F25B 27/02 | 62/238.4 |
| 3,151,467 | A * | 10/1964 | Cohen | C10L 3/04 | 62/48.1 |
| 3,234,744 | A * | 2/1966 | King | C10G 5/06 | 62/623 |
| 3,410,106 | A * | 11/1968 | Brockie | F25B 43/043 | 62/195 |
| 3,664,147 | A * | 5/1972 | Blackmon | F25B 43/043 | 62/85 |
| 4,169,356 | A * | 10/1979 | Kingham | F25B 43/00 | 62/85 |
| 4,776,175 | A * | 10/1988 | Romijn | F25B 43/043 | 62/85 |
| 5,201,185 | A * | 4/1993 | Hanson | B60H 1/3232 | 62/81 |
| 5,261,246 | A * | 11/1993 | Blackmon | F25B 43/043 | 62/85 |
| 5,313,805 | A * | 5/1994 | Blackmon | F25B 43/043 | 62/195 |
| 5,369,959 | A * | 12/1994 | Pfefferle | F25B 45/00 | 62/195 |
| 6,386,089 | B2 * | 5/2002 | Giversen | B62D 5/09 | 91/459 |
| 6,405,824 | B1 | 6/2002 | Sorensen et al. | | |
| 6,427,457 | B1 | 8/2002 | Pfefferle et al. | | |
| 6,668,967 | B2 | 12/2003 | Sorensen et al. | | |
| 6,912,455 | B2 | 6/2005 | Beek | | |
| 10,247,457 | B2 * | 4/2019 | Gu | F25B 31/00 | |
| 10,443,753 | B2 | 10/2019 | van Beek et al. | | |
| 10,488,088 | B2 | 11/2019 | Verma et al. | | |
| 2001/0032751 | A1 | 10/2001 | Giversen et al. | | |
| 2003/0074909 | A1 | 4/2003 | Heiden et al. | | |
| 2010/0199707 | A1 * | 8/2010 | Pearson | F25B 9/008 | 62/468 |
| 2012/0042667 | A1 | 2/2012 | Fulmer et al. | | |
| 2013/0283830 | A1 * | 10/2013 | Jandal | B01D 53/007 | 29/890.035 |
| 2013/0283832 | A1 | 10/2013 | Kujak et al. | | |
| 2015/0267930 | A1 * | 9/2015 | Ryu | F24F 5/001 | 62/503 |
| 2015/0377378 | A1 | 12/2015 | Birkelund et al. | | |
| 2017/0307269 | A1 | 10/2017 | Gu et al. | | |
| 2018/0306474 | A1 | 10/2018 | Uribe et al. | | |
| 2020/0063887 | A1 | 2/2020 | Vestergaard et al. | | |

FOREIGN PATENT DOCUMENTS

| | | | |
|---|---|---|---|
| CN | 105849482 | A | 8/2016 |
| CN | 108106283 | A | 6/2018 |
| CN | 108106283 | A * | 6/2018 |
| DE | 10255066 | A1 | 6/2004 |
| EP | 0115799 | A1 | 8/1984 |
| EP | 0256602 | A1 | 2/1988 |
| EP | 0345098 | A2 | 12/1989 |
| EP | 2861920 | A1 | 4/2015 |
| EP | 3106726 | A1 | 12/2016 |
| EP | 3499101 | A1 | 6/2019 |
| EP | 3591316 | A1 | 1/2020 |
| EP | 3660418 | A1 | 6/2020 |
| EP | 3660419 | A1 | 6/2020 |
| EP | 3660494 | A1 | 6/2020 |
| GB | 2360024 | A | 9/2001 |
| JP | 2000241049 | A | 9/2000 |
| JP | 2005226972 | A | 8/2005 |
| KR | 20160118748 | A | 10/2016 |
| WO | 2006116998 | A1 | 11/2006 |
| WO | 2006116999 | A1 | 11/2006 |
| WO | 2010107536 | A2 | 9/2010 |
| WO | 2013082401 | A1 | 6/2013 |
| WO | 2013165843 | A1 | 11/2013 |
| WO | 2014145584 | A1 | 9/2014 |
| WO | 2016000750 | A1 | 1/2016 |
| WO | 2017004009 | A1 | 1/2017 |
| WO | 2017011378 | A1 | 1/2017 |
| WO | 2017170627 | A1 | 10/2017 |
| WO | 2017170649 | A1 | 10/2017 |
| WO | 2018109036 | A1 | 6/2018 |
| WO | 2019040768 | A1 | 2/2019 |
| WO | 2019074764 | A1 | 4/2019 |
| WO | 2019074765 | A1 | 4/2019 |
| WO | 2019074767 | A1 | 4/2019 |
| WO | 2019074768 | A1 | 4/2019 |
| WO | 2020169220 | A1 | 8/2020 |
| WO | 2020187468 | A1 | 9/2020 |

OTHER PUBLICATIONS

Specifications, Applications, Service Instructions, & Parts for "Auto-Purger Plus, Appt Non-condensible Gas (Air) & Water Purger for Ammonia," Hansen, Bulletin APP-001f, pp. 1-28, Sep. 2016.
Installation and Maintenance Manual for "Grasso Self-Limiting Automatic Purger," GEA Refrigeration Netherlands N.V, pp. 1-28, Created Feb. 17, 2016.
Product Bulletin 75-00 E for "Auto Purger Model V200," Parker, Bulletin 75-00 E, pp. 1-12, Feb. 12, 2008.
International Search Report For Serial No. PCT/EP2019/066443 dated Jul. 30, 2019.
International Search Report For Serial No. PCT/EP2019/065120 dated Jul. 11, 2019.

* cited by examiner

APPARATUS FOR REMOVING NON-CONDENSABLE GASES FROM A REFRIGERANT

CROSS-REFERENCE TO RELATED APPLICATIONS

This application is a National Stage application of International Patent Application No. PCT/EP2019/067750, filed on Jul. 2, 2019, which claims priority to European Patent Application No. 18182229.7 filed on Jul. 6, 2018, each of which is hereby incorporated by reference in its entirety.

TECHNICAL FIELD

The present invention relates to an apparatus for removing non-condensable gases from a refrigerant, said apparatus comprising a pipe arrangement having a pipe, cooling means for the pipe, and venting means, wherein the pipe comprises a connection geometry for a connection to a refrigerant system.

BACKGROUND

Such an apparatus is known, for example, from EP 0 256 602 A1. The pipe is straight and oriented along the direction of gravity. The lower end of the pipe is connected to a vessel of a refrigerant system and is provided with a shut-off valve between the vessel and the pipe. The other end of the pipe is provided with venting means through which gas can be blown up into the air.

Such an apparatus can also be named "air purger". It is used to remove air and other non-condensable gases from an ammonia-refrigerant. Air is hindering a transfer of heat from the refrigerant to the cooling or heating surfaces, resulting in lower efficiency of the system.

The cooling means acting on the pipe have the effect that the refrigerant contained in the pipe condenses and changes its form into a liquid. The liquid can be fed back to the vessel by means of the shut-off valve. However, when opening the valve, the air which is heavier than the ammonia gas, enters again the vessel and has again to be purged which leads to a low efficiency of the air purger.

SUMMARY

The object underlying the invention is to have an air purger with a good efficiency.

This object is solved with an apparatus for removing non-condensable gases from a refrigerant as described at the outset in that the pipe comprises at least a first section and a second section which are directed in different directions.

The pipe can still directly be connected to the refrigerant system so that gas consisting of condensable and non-condensable gases can directly enter the interior of the pipe from the refrigerant system. The cooling means acting on the pipe can condense the condensable gases. The liquid produced by this condensation process can be fed back to the connection geometry to enter the refrigeration system. However, when the sections of the pipe are directed in different directions, they cannot all be directed in vertical direction. A direction of a section is defined as the relation between an inlet of a section, i.e. a first end close to the connection geometry, and an outlet of the section, i.e. a second end remote from the connection geometry. Even if two sections are arranged vertically, they can have different directions. When a section is not directed in vertical direction, i.e. parallel to the direction of gravity, the non-condensable gas in this section cannot flow back to the connection geometry or it flows back to the connection geometry with a smaller velocity since only a part of the gravity acts on the gas. The more of the non-condensable gas can be kept in the pipe and is blown out via the venting means, the better the efficiency.

Since only a pipe is used for the removal of the non-condensable gases, the interior of the pipe can be subjected to higher pressures, i.e. by the pressure of the refrigerant system, without having the need to fulfil the requirements of a high risk welding class which is expensive and time consuming for checking.

In an embodiment of the invention the first section comprises a first end close to the connection geometry and a second end remote from the connection geometry, wherein the first end is arranged at a lower height in direction of gravity than the second end, and the second section comprises a first end close to the connection geometry and a second end remote from the connection geometry, wherein the second end is arranged at a lower height in direction of gravity than the first end. With this construction the air entering the second section can no longer escape from the pipe via the connection geometry, since the air, which is heavier than the refrigerant, cannot flow back against the force of gravity from the second end of the second section remote from the connection geometry to the first end close to the connection geometry. Accordingly, the non-condensable gases are trapped in the pipe with the venting means as only exit. Non-condensable gas from the refrigerant system once purged is not again subjected to a purging process.

In an embodiment of the invention the second end of the first section and the first end of the second section are connected by a third section which is inclined upwardly. Condensable gas which condenses in the third section can flow back to the connection geometry.

In an embodiment of the invention the pipe comprises a fourth section which is inclined downwardly and connects the second section and a liquid outlet. Condensable gas which condenses in the second and fourth section can flow directly to the liquid outlet.

In an embodiment of the invention the liquid outlet is connected to the first section by means of a liquid trap. A liquid trap allows only liquid to escape but prevents the escape of any gases.

In an embodiment of the invention the liquid trap comprises a duct from the liquid outlet to an inlet opening in the first section, wherein the liquid outlet is arranged higher than a lower end of the inlet opening and lower than an upper end of the inlet opening. In this way it can be achieved that liquid entering the liquid outlet displaces liquid in the liquid trap without forming a larger liquid volume within the pipe.

In an embodiment of the invention the pipe comprises a fifth section connecting the fourth section to the venting means. The venting means can be arranged at a position higher in direction of gravity.

In an embodiment of the invention the fifth section is at least partly inclined upwardly. Accordingly, condensable gases condensing inside the fifth section can flow back to the liquid outlet.

In an embodiment of the invention the cooling means act on the fourth section and the fifth section. The fourth section and the fifth section can be made straight and can be made longer than the other sections, so that in these sections the condensing efficiency is the greatest.

In an embodiment of the invention a filler element is arranged in the fifth section. It is assumed that most of the condensable gases are already condensed in the fifth section and most part of the gas consists of non-condensable gases. Accordingly, the volume needed is smaller.

In an embodiment of the invention the fourth section comprises a first cooling jacket and the fifth section comprises a second cooling jacket, wherein the first cooling jacket comprises an inlet at one end and a connection to the second jacket at another end. Accordingly, the coolant which is used to remove heat from the pipe can flow through the first jacket, the connection, and the second jacket in a circulation.

In an embodiment of the invention the pipe has an inner diameter of 25 mm or less. A small diameter facilitates the low welding risk classification. When having such a small inner diameter, no certified welders and X-ray scanning of the weldings are necessary. It is sufficient to rely solely on pressure testing of the weldings.

BRIEF DESCRIPTION OF THE DRAWINGS

A preferred embodiment will now be described in more detail with reference to the drawing, wherein.

DETAILED DESCRIPTION

Figure 1:
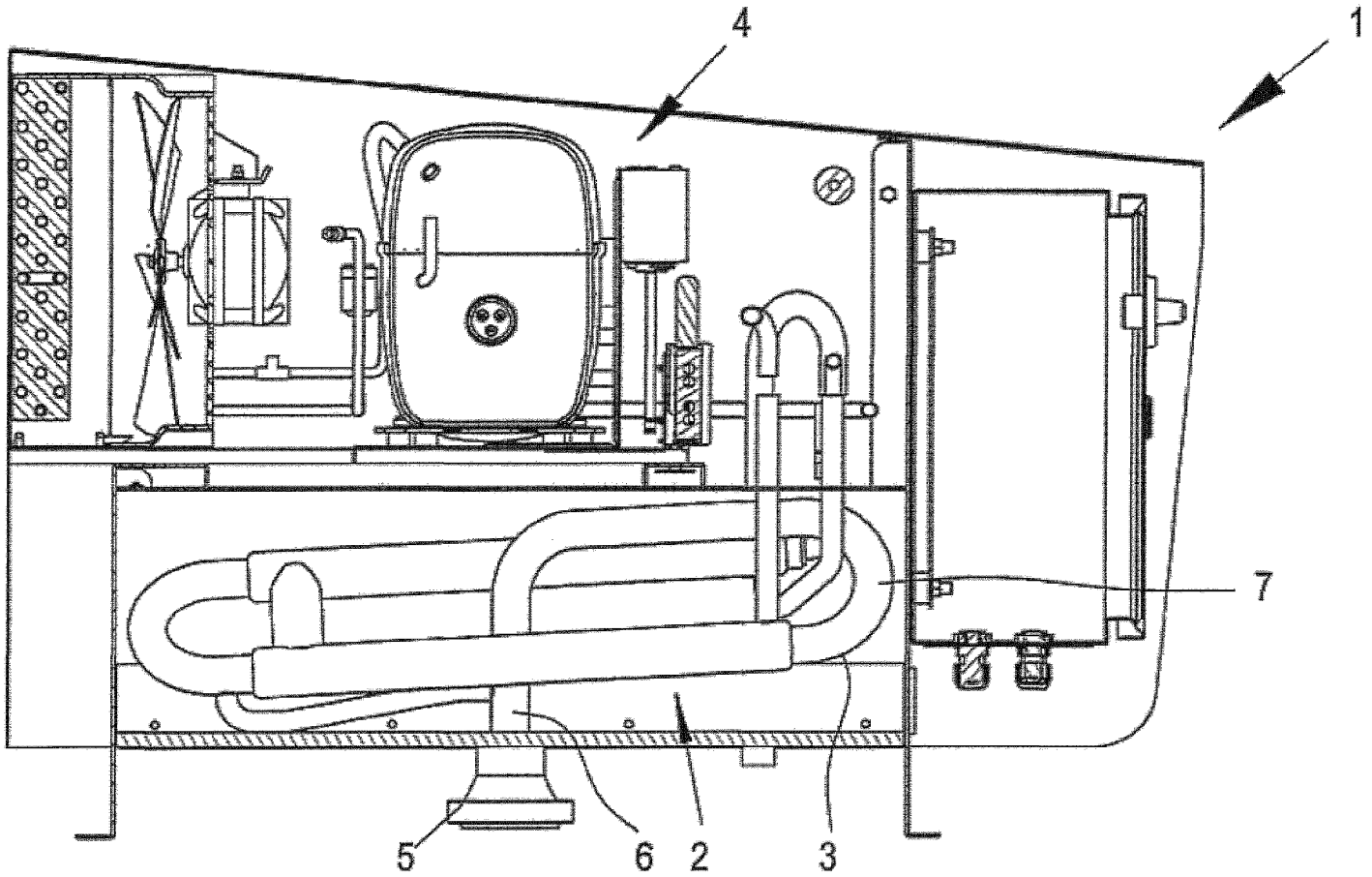
FIG. 1 shows schematically an apparatus for removing non-condensable gases from a refrigerant.

FIG. 1 shows an apparatus 1 for removing non-condensable gases from a refrigerant. The apparatus 1 can also be named "air purger".

The apparatus 1 comprises a pipe arrangement 2. The pipe arrangement 2 comprises a pipe 3, cooling means 4 for the pipe and a connection geometry 5 for a connection to a refrigerant system (not shown in the drawing). The apparatus 1 can directly be connected to the refrigerant system. The refrigerant system is operated with an ammonia-refrigerant. The refrigerant can have a pressure in a range from 6 to 25 bar, depending on where in the refrigeration system the air purger is arranged.

The pipe 3 has in inner diameter of 25 mm or less to facilitate the low welding risk classification. When the inner diameter does not exceed the 25 mm a certified welder is not required and X-ray testing of the weldings is not necessary. It is sufficient to rely solely on pressure testing of the weldings.

Figure 2:
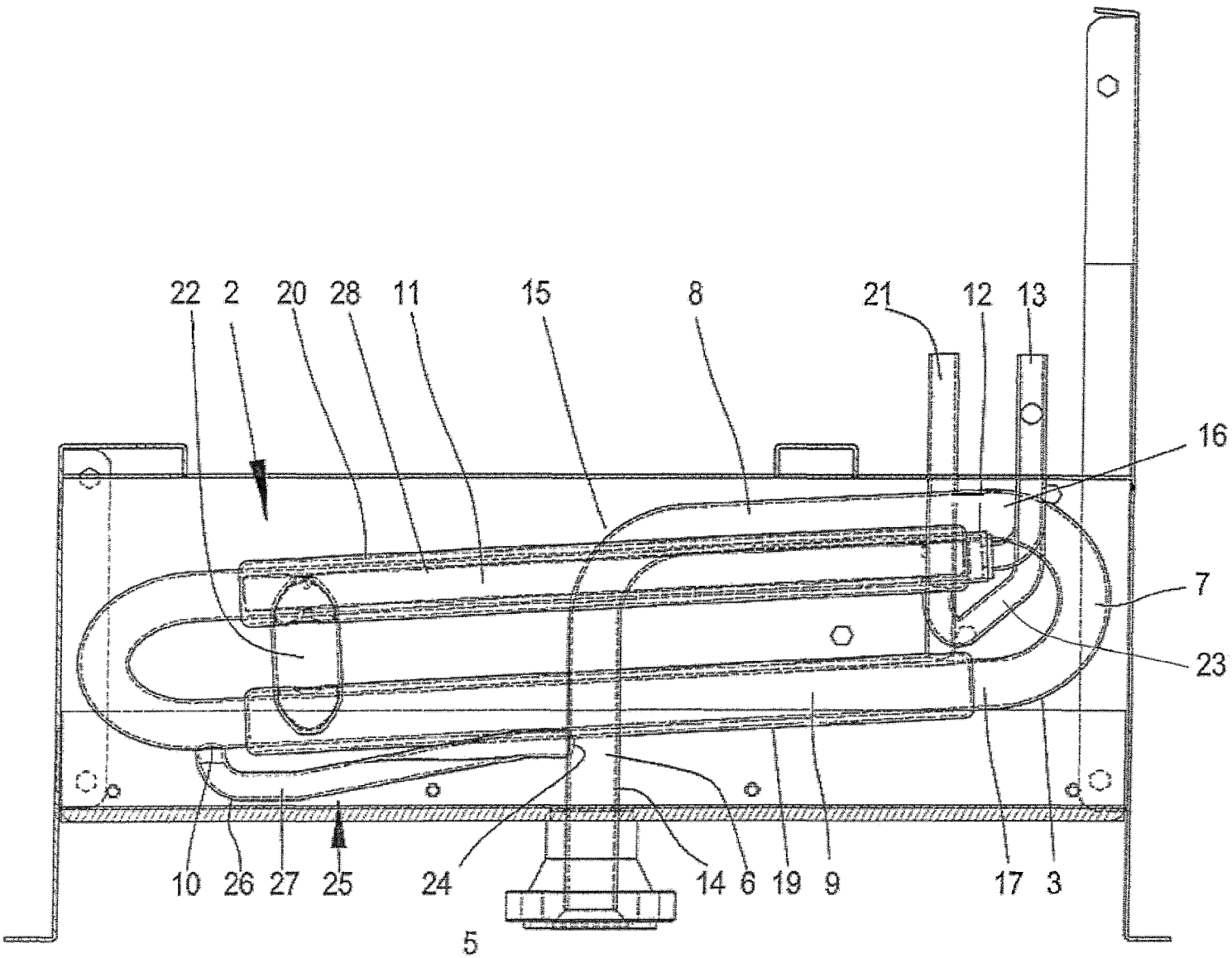
FIG. 2 shows the pipe arrangement in more detail.

The pipe arrangement 2 is shown in more detail in FIG. 2. Same reference numerals are used for the same elements.

The pipe 3 comprises a first section 6 which is oriented vertically, i.e. parallel to the direction of gravity. The first section 6 is connected to the connection geometry 5.

The first section 6 is connected to a second section 7 via a third section 8. The second section 7 is connected to a fourth section 9 which connects the second section 7 to a liquid outlet 10. The fourth section 9 is connected to a fifth section 11. The fifth section 11 comprises at an end 12 venting means 13 in a position remote from the liquid outlet 10.

The first section 6 comprises a first end 14 close to the connection geometry 5 and a second end 15 remote from the connection geometry 5. The second section 7 comprises a first end 16 closer to the connection geometry 5 and a second end 17 remote from the connection geometry 5. The terms "close" and "remote" relate to a distance through which a gas has to flow from the connection geometry 5 to the respective ends.

As it comes out from FIG. 2, the first end 14 of the first section 6 is arranged at a lower height in direction of gravity than the second end 15. Likewise, the second end 17 of the second section 7 is arranged at a lower height in gravity direction than the first end 16.

Since air and other non-condensable gases are heavier than the refrigerant vapour, the non-condensable gases cannot escape from the pipe 3 once they have entered the second section 7.

The third section 8 is slightly inclined upwardly with the effect that refrigerant or condensable gases which condense in the third section 8 can directly flow back to the connection geometry 5. However, since the gravity works only with a rather small component on the non-condensable gas in the third section 8 this non-condensable gas is not driven back to the connection geometry 5.

The fourth section 9 is slightly inclined downwardly and the fifth section 11 is slightly inclined upwardly over a large part of its length. A U-shaped part 18 of the fifth section 11 connects to the fourth section 9.

The fourth section 9 is surrounded by a first cooling jacket 19 and the fifth section 11 is surrounded by a second cooling jacket 20 at least over its straight part. The first cooling jacket 19 is supplied with a cooling medium from the cooling means 4 via an inlet pipe 21. The first cooling jacket 19 is connected to the second cooling jacket 20 by means of a connecting pipe 22 and the other end of the second cooling jacket 20 is connected to the cooling means by means of an outlet pipe 23.

The liquid outlet is connected to an inlet opening 24 in the first section 6, more precisely in a lower part of the first section 6 of the pipe 3. This connection is made by means of a liquid trap 25. The liquid trap 25 comprises a duct 26 which is arranged in a position lower than the fourth section 9.

As can be seen in FIG. 2, the liquid outlet 10 is arranged higher than a lower end of the inlet opening 24 and lower than an upper end of the inlet opening 24. Accordingly, in the duct 26 there is permanently a volume of liquid 27 which prevents a flow of gas through the duct 26.

As soon as the level of the liquid 27 in duct 26 rises, the liquid flows over into the first section 6 and from there to the connection geometry 5. On the other hand, it is hardly possible that a larger volume of liquid collects within the fourth section 9.

The operation of the air purger can be described as follows:

When the connection geometry 5 is connected to the refrigerant system, a gas containing condensable gases and non-condensable gases enters the pipe 3 via the connection geometry 5. This gas fills the interior of the pipe 3. The fourth section 9 and the fifth section 11 cool down to a temperature at which the condensable gases can condense. The liquid forming in this condensing process flows under the action of gravity to the liquid outlet 10 and from there through the liquid trap 25 back to the first section 6, however, without any gas.

Non-condensable gases are trapped within pipe 3 once they have reached the second section 7. The non-condensable gases can escape only via venting means 13 at the end of the fifth section 11. The venting means 13 can comprise, for example, a controlled venting valve.

The fifth section 11 comprises a filler element 28 reducing the free volume within the fifth section 11. In the fifth section 11 a large part of the condensable gases has already been condensed and the filler element 28 is used to increase the heat transfer from the gas within the fifth section 11 to cooling medium within the second cooling jacket 20.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. An apparatus for removing non-condensable gases from a refrigerant, said apparatus comprising a pipe arrangement having a pipe, cooling means for the pipe, and a vent, wherein the pipe comprises a connection geometry for a connection to a refrigerant system, wherein the pipe comprises at least a first section and a second section which are directed in different directions, wherein the first section comprises a first end close to the connection geometry and a second end remote from the connection geometry, wherein the first end is arranged at a lower height in direction of gravity than the second end.

2. The apparatus according to claim 1, wherein the second section comprises a first end close to the connection geometry and a second end remote from the connection geometry, wherein the second end is arranged at a lower height in direction of gravity than the first end.

3. The apparatus according to claim 2, wherein the second end of the first section and the first end of the second section are connected by a third section which is inclined upwardly.

4. The apparatus according to claim 2, wherein the pipe comprises a fourth section which is inclined downwardly and connects the second section and a liquid outlet.

5. The apparatus according to claim 4, wherein the liquid outlet is connected to the first section by means of a liquid trap.

6. The apparatus according to claim 5, wherein the liquid trap comprises a duct from the liquid outlet to an inlet opening in the first section, wherein the liquid outlet is arranged higher than a lower end of the inlet opening and lower than an upper end of the inlet opening.

7. The apparatus according to claim 4, wherein the pipe comprises a fifth section connecting the fourth section to the vent.

8. The apparatus according to claim 7, wherein the fifth section is at least partly inclined upwardly.

9. The apparatus according to claim 7, wherein the cooling means act on the fourth section and the fifth section.

10. The apparatus according to claim 7, wherein a filler is arranged in the fifth section.

11. The apparatus according to claim 7, wherein the fourth section comprises a first cooling jacket and the fifth section comprises a second cooling jacket, wherein the first cooling jacket comprises an inlet at one end and a connection to the second jacket at another end.

12. The apparatus according to claim 1, wherein the pipe has an inner diameter of 25 mm or less.

13. The apparatus according to claim 3, wherein the pipe comprises a fourth section which is inclined downwardly and connects the second section and a liquid outlet.

14. The apparatus according to claim 5, wherein the pipe comprises a fifth section connecting the fourth section to the vent.

15. The apparatus according to claim 6, wherein the pipe comprises a fifth section connecting the fourth section to the vent.

16. The apparatus according to claim 8, wherein the cooling jacket act on the fourth section and the fifth section.

17. The apparatus according to claim 8, wherein a filler is arranged in the fifth section.

18. The apparatus according to claim 9, wherein a filler is arranged in the fifth section.

19. The apparatus according to claim 8, wherein the fourth section comprises a first cooling jacket and the fifth section comprises a second cooling jacket, wherein the first cooling jacket comprises an inlet at one end and a connection to the second jacket at another end.

20. The apparatus according to claim 9, wherein the fourth section comprises a first cooling jacket and the fifth section comprises a second cooling jacket, wherein the first cooling jacket comprises an inlet at one end and a connection to the second jacket at another end.

* * * * *